US005930931A

United States Patent [19]

Watson

[11] Patent Number: 5,930,931

[45] Date of Patent: Aug. 3, 1999

[54] ADJUSTABLE GUN REST

[76] Inventor: Jerry Wade Watson, P.O. Box 324, Foxworth, Miss. 39483

[21] Appl. No.: 08/931,069

[22] Filed: Sep. 15, 1997

[51] Int. Cl.[6] ..... F41A 23/04; F41C 29/00

[52] U.S. Cl. ..... 42/94; 42/94; 89/37.01; 206/317

[58] Field of Search ..... 42/94, 96, 90; 89/37.01, 37.04; 206/317, 3, 349

[56] References Cited

U.S. PATENT DOCUMENTS

| | | | |
|---|---|---|---|
| 879,052 | 2/1908 | Jeranek | 42/94 |
| 1,112,732 | 10/1914 | Uhl | 42/94 |
| 1,890,423 | 12/1932 | Teagarden | 42/94 |
| 3,225,656 | 12/1965 | Flaherty | 42/94 |
| 3,648,396 | 3/1972 | Smith | 42/94 |
| 4,575,964 | 3/1986 | Griffin | 42/94 |
| 4,676,021 | 6/1987 | Groba | 42/94 |
| 4,844,390 | 7/1989 | Duke | 42/94 |
| 5,018,294 | 5/1991 | McGuffee | 42/94 |
| 5,345,706 | 9/1994 | Brown | 42/94 |
| 5,402,595 | 4/1995 | Tamllos | 42/94 |
| 5,414,949 | 5/1995 | Peebles | 42/94 |
| 5,528,846 | 6/1996 | Baggett | 42/94 |
| 5,685,103 | 11/1997 | Wiggins | 42/94 |

FOREIGN PATENT DOCUMENTS

| | | | |
|---|---|---|---|
| 113443 | 9/1900 | Germany | 42/94 |
| 308 | 2/1861 | United Kingdom | 42/94 |

*Primary Examiner*—Charles T. Jordan
*Assistant Examiner*—Denise J Buckley
*Attorney, Agent, or Firm*—Warner J. Delaune

[57] ABSTRACT

A portable gun rest is provided, comprising a thigh support member adapted to fit over a user's thigh; a telescoping support assembly pivotally connected to the thigh support member, wherein the telescoping support assembly includes a longitudinal axis; and a gun support member connected to the telescoping support assembly, wherein the gun support member is rotatable about the longitudinal axis of the support member. The telescoping support assembly preferably includes a first member and a second member, wherein the first member is lockingly slidable relative to the second member. The gun rest further includes a flexible strap connected to the thigh support member, wherein the strap is capable of fastening the thigh support member to the user's thigh. A locking mechanism is disposed between the telescoping support assembly and the thigh support member, wherein the locking mechanism is shaped and dimensioned to fix the rotational position of the telescoping support assembly relative to the thigh support member. Preferably, a cushioned surface is attached to the underside of the thigh support assembly for more comfortable use and so that the gun rest resists slippage while in use.

7 Claims, 2 Drawing Sheets

ADJUSTABLE GUN REST

BACKGROUND OF THE INVENTION

I. Field of the Invention

The present invention relates generally to gun rests for use by hunters and marksmen, and more particularly to gun rests which are adapted to rest upon the thigh while the hunter is sitting in a tree stand, or in a standing or kneeling position.

II. Description of Prior Art

In the field of hunting, the hunter is never assured of being able to make a comfortable and accurate shot at his quarry. Particularly in big game hunting, such as in the case of deer, antelope, and the like, the hunter is often presented with an opportunity to shoot when he is least capable of establishing a steady aim. If the hunter is fortunate enough to be near a tree, he will often lean against the tree and prop the forestock of his rifle between his hand and the tree. However, using this technique is impossible if no trees are nearby, or if the animal would be alerted to the hunter's presence while the hunter attempts to move closer to a nearby tree. Thus, there are times when the hunter must shoot from his present location without the aid of a tree.

Many prior devices have been developed to address this situation, as represented by the following U.S. Pat. Nos. 4,575,964 issued to Griffin; 4,676,021 issued to Groba; 5,018,294 issued to McGuffee; 5,345,706 issued to Brown; and 5,402,595 issued to Tamllos. Of the above patents, the Griffin patent appears to be most accommodating to the hunter, in terms of stability and speed. That device comprises a telescopic support assembly having a lower saddle member which roughly fits onto the hunter's thigh, as well as an upper saddle member that receives the forestock of a rifle or shotgun. A locking pin, which is carried on a cord attached to the device, is used to adjustably fix the position of the telescoping members so that the shooting height is most comfortable for the hunter. The cord for the locking pin also serves as a carrying strap when the gun rest is not in use.

Despite its advantages, there are a number of deficiencies with the Griffin gun rest that prevent it from becoming a more useful device. For example, the device is ill-suited to situations where the rifle must be aimed in a direction which is not substantially parallel to the hunter's thigh, because the locking pin necessarily prevents rotation of one telescoping member within the other. While the locking pin may be removed to allow such rotation, the hunter must sacrifice the ability to lock the upper saddle member to a height that is comfortable and appropriate for the particular shot. Also, the Griffin device lacks a means of securing the thigh portion to the hunter's leg, which would assist in making a steady shot. Furthermore, the telescoping support assembly is fixed with respect to the thigh support, whereas a pivotal connection would enable several important benefits which will be explained below.

Therefore, a versatile and easy-to-use gun rest is needed for situations where the hunter has no natural structures with which to assist in the aiming of his firearm. Such a gun rest must allow the hunter to quickly and noiselessly position the gun rest under the firearm, while being adjustable in both the height and in the horizontal rotation plane. The gun rest should also be highly portable and allow the vertical support to lockably pivot relative to the thigh support so as to enable the gun rest to be worn even when not in use. From a reading of the following description, it will become apparent that the present invention meets all of these criteria.

SUMMARY OF THE INVENTION

It is therefore an object of this invention to provide a versatile gun rest having a thigh support member enabling the hunter to aim a firearm.

It is also an object of this invention to provide a gun rest having a means to aim the firearm in a wide range of horizontal directions.

It is a further object of this invention to provide a gun rest which is lightweight and adjustable in a variety of ways for use in aiming the firearm and carrying the gun rest when not in use.

Yet another object of this invention is to provide a gun rest which includes a strap for attaching the gun rest to the hunter's leg.

These and other objects and advantages of the present invention will no doubt become apparent to those skilled in the art after having read the following description of the preferred embodiment which are contained in and illustrated by the various drawing figures.

Therefore, in a preferred embodiment, a portable gun rest is provided, comprising a thigh support member adapted to fit over a user's thigh; a telescoping support assembly pivotally connected to the thigh support member, wherein the telescoping support assembly includes a longitudinal axis; and a gun support member connected to the telescoping support assembly, wherein the gun support member is rotatable about the longitudinal axis of the support member. The telescoping support assembly preferably includes a first member and a second member, wherein the first member is lockingly slidable relative to the second member. The gun rest further includes a flexible strap connected to the thigh support member, wherein the strap is capable of fastening the thigh support member to the user's thigh. A locking mechanism is disposed between the telescoping support assembly and the thigh support member, wherein the locking mechanism is shaped and dimensioned to fix the rotational position of the telescoping support assembly relative to the thigh support member. Preferably, a cushioned surface is attached to the underside of the thigh support assembly for more comfortable use and so that the gun rest resists slippage while in use.

DETAILED DESCRIPTION OF THE PREFERRED EMBODIMENTS

Figure 1:
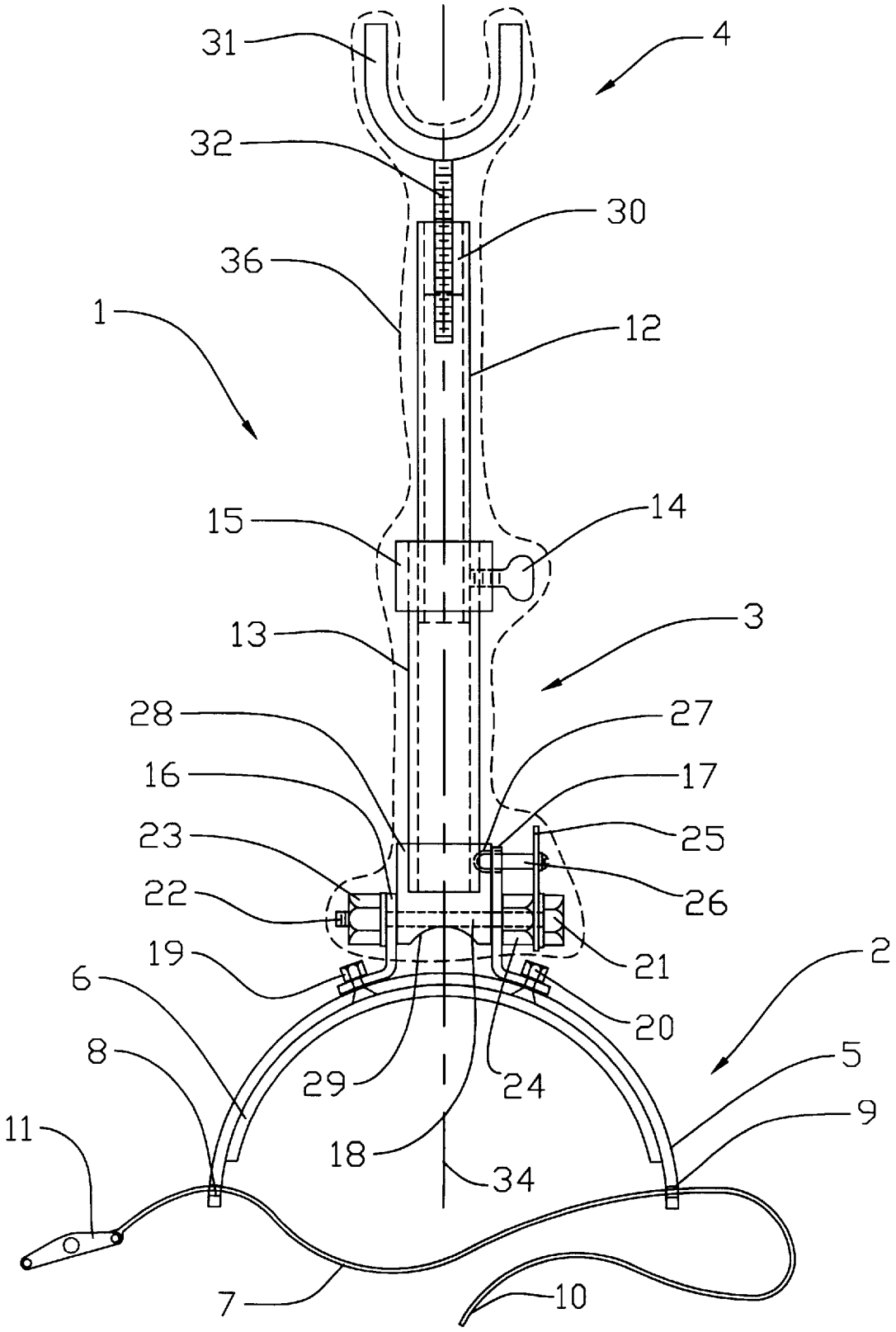
FIG. 1 is a cross-sectional elevation view of a preferred embodiment of the present invention which depicts the various ways in which the gun rest may be adjusted.

Turning now to FIG. 1, a preferred embodiment 1 of the gun rest of the present invention is depicted which generally comprises a thigh support member 2, telescoping support member 3, and a gun rest member 4. Unless otherwise specified, all of the components of the invention, except for fastening hardware, may be constructed of any suitable and durable plastic, which allows the gun rest to remain as lightweight as possible. It will be appreciated that many other materials may alternatively be used, such as aluminum or steel, but that the gun rest may become heavier and more difficult to carry.

Figure 2:
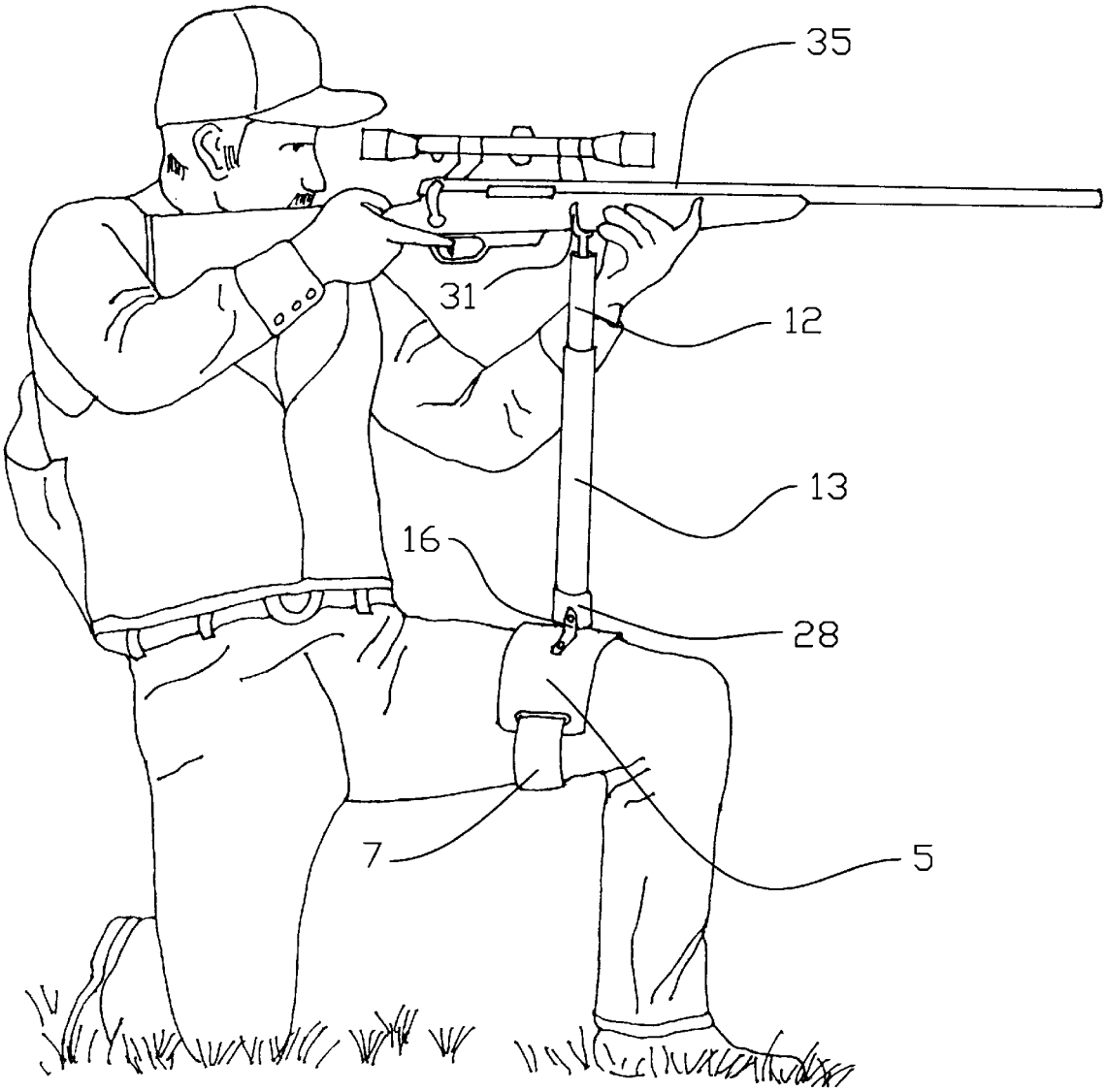
FIG. 2 is a perspective view of a hunter using the present invention.

The thigh support member 2 includes a roughly C-shaped plate 5 which should conform approximately to the user's thigh, as shown in FIG. 2. Preferably, thigh support member 2 further includes a cushion 6 of foam rubber or similarly soft material which is adhesively attached to the underside of thigh support member 2. The cushion 6 provides the necessary comfort to the user during aiming and shooting, and it assists in the prevention of undesirable slippage as well. A flexible strap 7 is connected to thigh support member 2 by passing it through a pair of slots 8, 9 formed into the ends of thigh support member 2. Strap 7 includes a free end 10 as well as an end having a buckle 11. During use, and as will be further explained herein, the free end 10 is inserted through the buckle 11 and looped so that pulling on the free end 10 will tighten strap 7 as well known in the art of fastening straps. Although not required, strap 7 may also possess elastic characteristics, so that flexion of the upper leg muscles may be accommodated for more comfortable use.

Telescoping support assembly 3 is generally comprised of a first member 12 and a second member 13, both of which are hollow, wherein the first member 12 is lockingly slidable relative to the second member 13. In a preferred configuration, the first member 12 is telescopingly slidable within the second member 13, and locked in any desired position by way of a set screw 14. Second member 13 includes an upper collar 15 to provide the material within which set screw 14 operates. Advantageously, the use of a set screw 14 enables the hunter to position the height of his firearm 35 at many different positions, as opposed to only a limited number of discrete positions allowed by prior devices.

Second member 13 is pivotally connected to thigh support member 2 by way of a pair of brackets 16, 17 and an associated pin 18. As best illustrated in FIG. 1, brackets 16, 17 are each preferably fastened to thigh support member 2 by a common bolt, nut and lock washer combination 19, 20, respectively. Pin 18 is preferably a bolt 21 passing though corresponding holes (not shown) in brackets 16, 17, wherein the threaded end 22 of bolt 21 includes a nut and washer combination 23. An additional nut, or spacer 24, is provided between the bolt head 21 and bracket 17 to accommodate a cantilevered plate spring 25 which extends above pin 18. Cantilevered spring 25 further includes an attached locking pin 26 which extends through a hole in bracket 17. Locking pin 26 extends past bracket 17 so that it becomes matable with a corresponding locking hole 27 formed into a lower collar 28 on second member 13. Thus, locking pin 26 can be removed from locking hole 27 by simply pulling back on cantilevered spring 25, allowing the entire telescoping support assembly 3 to freely pivot relative to thigh support member 2 about pin 18. In order to provide the maximum degree of rotation of telescoping support assembly 3 about pin 18, a fillet 29 is formed underneath lower collar 28. Fillet 29, therefore, permits a closer relationship between pin 18 and thigh support member 2. To lock the telescoping support assembly 3, the user simply pulls it into place until the locking pin 26 snaps into locking hole 27.

First member 12 includes an upper threaded insert 30 having internal threads which are matable with gun support member 4. Gun support member 4 includes a generally U-shaped bracket 31 having a downwardly extending shaft 32 with external threads matable within threaded insert 30. This arrangement allows gun support member 4 to rotate about the longitudinal axis 34 of telescoping support assembly 3, which enables the hunter to fine-tune the height of the firearm 35, as well as to aim the firearm 35 through a wide range of horizontal angles without shifting positions.

Although not strictly required for operation of the invention, it is preferred that the gun rest include a noise-resistant sleeve 36 covering the telescoping support member 3 and the gun support member 4, as shown in FIG. 1. Sleeve 36 should be constructed from an open-ended camouflaged material loosely fitted around the first and support members 12, 13 and the U-shaped bracket 31, and should be sufficiently long to allow for maximum extension of first member 12 while providing complete coverage for all components. Sleeve 36 serves to prevent undesired, high-pitched noises resulting from contact against the metal or plastic parts while in the field, because the material helps to absorb or dissipate any such sounds. The material of sleeve 36 should be sufficiently loose to cover set screw 14 and most of the connective hardware at the base of second member 13, while allowing rotation of U-shaped bracket 31.

The gun rest may be carried in a variety of ways. For example, it may simply be carried in one hand while the firearm 35 is carried in the other hand. Alternatively, the gun rest may be fastened to the user's thigh using the strap 7, with the telescoping support assembly 3 unlocked and pivoted downwardly against the user's leg while walking. In this manner, the hunter may quickly move to a kneeling position and lock the position of the telescoping support assembly 3 into a vertical orientation, as shown in FIG. 2. Also, if the hunter intends to walk for longer distances, thigh support member 2 may be attached to the hunter's belt by passing the belt through the slots 8, 9 while the telescoping support assembly 3 is unlocked and pointing downward.

Although the present invention has been described in terms of specific embodiments, it is anticipated that alterations and modifications thereof will no doubt become apparent to those skilled in the art. For example, although a specific spring-loaded locking device is shown in the figures, a similar result may be obtained by a variety of functionally equivalent means. Likewise, the use a set screw to fix the position of the telescoping support members may also be accomplished by a tightenable collar, a cam-type lock or other similar device. It is therefore intended that the following claims be interpreted as covering all such alterations and modifications as fall within the true spirit and scope of the invention.

I claim:

1. A portable gun rest, comprising:

(a) a thigh support member adapted to fit over a user's thigh;

(b) a telescoping support assembly hingeably connected to said thigh support member with a planar range of greater than 90 degrees, said telescoping support assembly having a longitudinal axis; and (c) a gun support member rotatably connected to said telescoping support assembly.

2. The gun rest of claim 1, further comprising a flexible strap connected to said thigh support member, wherein said strap is capable of fastening said thigh support member to said user's thigh.

3. The gun rest of claim 1, further comprising a locking mechanism disposed between said telescoping support assembly and said thigh support member, wherein said locking mechanism is shaped and dimensioned to fix the rotational position of said telescoping support assembly relative to said thigh support member.

4. The gun rest of claim 1, wherein said telescoping support assembly includes a first member and a second member, wherein said first member is lockingly slidable relative to said second member.

5. The gun rest of claim 1, wherein said gun support member is rotatable about said longitudinal axis of said telescoping support assembly.

6. The gun rest of claim 1, wherein said thigh support member includes a cushioned surface for contacting said user's thigh.

7. The gun rest of claim 1, further comprising a noise-resistant sleeve surrounding said telescoping support member and said gun support member.

* * * * *